US008509656B2

(12) United States Patent
Kopp

(10) Patent No.: US 8,509,656 B2
(45) Date of Patent: Aug. 13, 2013

(54) DEVICE TO DEVELOP CHARGE IMAGES GENERATED ON A CHARGE IMAGE CARRIER IN AN ELECTROPHORETIC PRINTING APPARATUS

(75) Inventor: Christian Kopp, Planegg (DE)

(73) Assignee: Océ Printing Systems GmbH, Poing (DE)

( * ) Notice: Subject to any disclaimer, the term of this patent is extended or adjusted under 35 U.S.C. 154(b) by 306 days.

(21) Appl. No.: 12/970,481

(22) Filed: Dec. 16, 2010

(65) Prior Publication Data

US 2011/0150534 A1 Jun. 23, 2011

(30) Foreign Application Priority Data

Dec. 23, 2009 (DE) ..... 10 2009 060 334

(51) Int. Cl.
*G03G 15/10* (2006.01)
*B41J 29/38* (2006.01)
*B41J 2/17* (2006.01)

(52) U.S. Cl.
USPC ..... 399/237; 399/57; 399/239; 399/241; 347/5; 347/6; 347/7; 347/73; 347/85

(58) Field of Classification Search
USPC ..... 399/57, 237, 239, 241; 347/5, 6, 347/7, 73, 84, 85
See application file for complete search history.

(56) References Cited

U.S. PATENT DOCUMENTS

| | | | | |
|---|---|---|---|---|
| 3,633,544 | A * | 1/1972 | Weiler | 118/629 |
| 3,782,818 | A * | 1/1974 | Smith | 399/56 |
| 3,972,305 | A * | 8/1976 | Sato | 399/238 |
| 4,050,806 | A * | 9/1977 | Miyakawa et al. | 399/56 |
| RE31,964 | E * | 8/1985 | Schaefer et al. | 399/56 |
| 4,678,317 | A * | 7/1987 | Grossinger | 399/56 |
| 5,036,365 | A | 7/1991 | Landa | |
| 5,689,779 | A * | 11/1997 | Miyamoto et al. | 399/237 |
| 5,724,629 | A * | 3/1998 | Iino et al. | 399/57 |
| 5,752,143 | A * | 5/1998 | Wayman | 399/248 |
| 5,826,148 | A * | 10/1998 | Iino et al. | 399/240 |
| 6,246,856 | B1 | 6/2001 | Kopp et al. | |
| 2003/0133726 | A1 * | 7/2003 | Song et al. | 399/237 |
| 2006/0153596 | A1 * | 7/2006 | Gilan et al. | 399/237 |
| 2006/0153597 | A1 * | 7/2006 | Guzman et al. | 399/237 |
| 2008/0279597 | A1 | 11/2008 | Berg et al. | |
| 2008/0310870 | A1 | 12/2008 | Berg et al. | |

FOREIGN PATENT DOCUMENTS

| | | | |
|---|---|---|---|
| DE | 102005055156 | B3 | 5/2007 |
| WO | 9839691 | | 9/1998 |
| WO | 2007082791 | A1 | 7/2007 |

* cited by examiner

*Primary Examiner* — David Gray
*Assistant Examiner* — Francis Gray
(74) *Attorney, Agent, or Firm* — Schiff Hardin LLP

(57) ABSTRACT

In a device or method to develop charge images generated on a charge image carrier, a rotating applicator moves developer fluid having charged toner particles charged to a predetermined charge and carrier fluid past the charge image carrier. The developer fluid is moved into a developer gap between the applicator and a counter-electrode where it is exposed to an electrical field between the counter-electrode and the applicator. The toner particles of the predetermined charge are moved in a direction of the applicator depending on their charge, uncharged toner particles remaining unaffected and toner particles of opposite charge being repelled. Via a separation electrode protruding into the developer gap, the developer fluid in the developer gap is divided at an exit of the developer gap into a first partial flow adjacent to the application electrode and into a second partial flow adjacent to the counter-electrode where it is discharged.

12 Claims, 1 Drawing Sheet

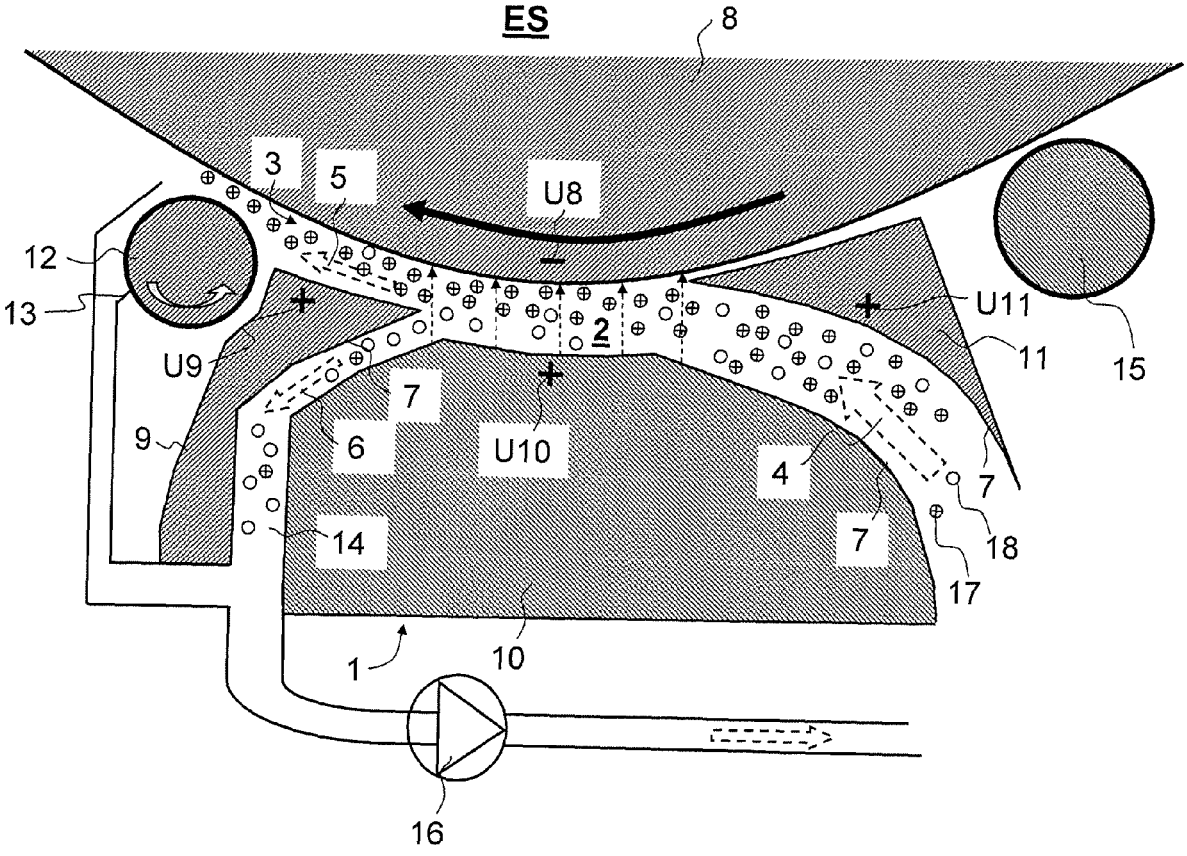
ES
8
3
5
U8
12
13
U9
9
2
U11
11
15
7
6
U10
4
7
14
7
18
17
1
10
16

DEVICE TO DEVELOP CHARGE IMAGES GENERATED ON A CHARGE IMAGE CARRIER IN AN ELECTROPHORETIC PRINTING APPARATUS

BACKGROUND

Electrographic printing or copying apparatuses are known—see for example WO 98/39691 A1. In such a printing or copying apparatus, charge images of the images to be printed are generated by a character generator on a charge image carrier, for example a photoconductor belt. The charge image carrier is subsequently moved past developer stations, respectively one per color. Thus the developer with toner particles is transported to the charge image carrier. The toner particles transfer to the charge image carrier corresponding to the charge images on the charge image carrier and ink the charge image carrier. The toner images are transfer-printed to a printing substrate in the next step and are fixed thereon. The precise workflow of the printing method can be learned from WO 98/39691 A1, a content of which is herewith incorporated into this specification by reference.

A developer fluid having at least toner particles and carrier fluid can thereby be used to ink the charge images. Possible carrier fluids are, among other things, silicon oil or hydrocarbons. One method for such an electrophoretic liquid development in digital printing apparatuses is known from WO 2007/082791 A1, for example. A carrier fluid containing silicon oil with toner particles dispersed in it is thereby used as a developer fluid; charge control substances can additionally be added to the developer fluid.

The feed of the developer fluid to the charge image carrier can take place via an applicator; for example an application roller or developer roller or an application belt that moves the developer fluid past the charge image carrier. The developer fluid can be supplied to the applicator by, for example, an inking roller across a developer gap existing between the inking roller and the applicator. For this an electrical field can be generated across the developer gap between the inking roller and the applicator, via which electrical field the electrically charged toner particles are drawn to the applicator.

A sufficient electrophoretic mobility of the toner particles in the carrier fluid and a uniform layer of developer fluid on the applicator are significant for the development of the charge images. The mobility of the toner particles is thereby affected by their charge, wherein the charge can be adjusted via the concentration of charge control substances in the developer fluid. In one development principle in which the developer fluid consists exclusively of carrier fluid, toner particles and charge control substances, the electrical conductivity of the developer fluid depends on the concentration of the charge control substances in the developer fluid. This can be established via measurement. For example, if the electrical conductivity of the developer fluid should fall below a desired value during operation, the desired concentration can be corrected via addition of charge control substances and the mobility of the toner particles can be changed. A disadvantage of this method is that the mobility of the toner particles is only indirectly and integrally assessed, and therefore weakly charged toner particles (or toner particles discharged at surfaces) can also arrive at the applicator. Ionic contaminations, injections of charge carriers from boundary surfaces that have a difference potential relative to at least one adjacent surface, and runtime-conditional degradations of the toner particles can therefore lead to an unwanted change of the correlation between conductivity and corresponding change of the particle charge or the electrophoretic mobility. Such a modification of this correlation then leads to an incorrect regulation of the charge control substances that can imply a change of the toner behavior in the printing process and therefore a degradation of the print quality.

SUMMARY

It is an object to specify a device and a method to develop charge images using a developer fluid in an electrophoretic printing apparatus in which the problems illustrated above do not occur.

In a device or method to develop charge images generated on a charge image carrier, a rotating applicator moves developer fluid having charged toner particles charged to a predetermined charge and carrier fluid past the charge image carrier. The developer fluid is moved into a developer gap between the applicator and a counter-electrode where it is exposed to an electrical field between the counter-electrode and the applicator. The toner particles of the predetermined charge are moved in a direction of the applicator depending on their charge, uncharged toner particles remaining unaffected and toner particles of opposite charge being repelled. Via a separation electrode protruding into the developer gap, the developer fluid in the developer gap is divided at an exit of the developer gap into a first partial flow adjacent to the application electrode and into a second partial flow adjacent to the counter-electrode where it is discharged.

BRIEF DESCRIPTION OF THE DRAWING

The drawing FIGURE illustrates a predefined embodiment of the device to develop the charge images.

DESCRIPTION OF THE PREFERRED EMBODIMENT

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modification in the illustrated method and such further applications of the principals of the invention as illustrated as would normally occur to one skilled in the art to which the invention relates are included.

An object is to weed out toner particles of unsuitable electrophoretic mobility and to simultaneously ensure a uniform layer of developer fluid on the applicator.

The method according to the preferred embodiment for the development of charge images generated on a charge image carrier with developer fluid has at least charged toner particles and carrier fluid using a rotating applicator—for example an application roller or an application belt—that moves the developer fluid past the charge image carrier. The developer fluid is moved through a developer gap between the applicator and a counter-electrode. There the toner particles, depending on their charge, are moved in the direction of the applicator via an electrical field existing between counter-electrode and applicator. Via a separation electrode protruding into the developer gap at its exit, the developer fluid is divided into a first partial flow in which are contained the toner particles that are drawn sufficiently far towards the applicator due to their charge (toner particles with sufficient electrophoretic mobility=mobile toner particles) and a second partial flow in which are contained the remaining toner particles that did not move sufficiently far towards the applicator (toner particles with insufficient electrophoretic mobility=immobile toner particles). The second partial flow can then be conducted back into the developer station and be recharged there via the addition of charge control substances, or can be directed back into the regular toner particle circulation, or be sorted out from the toner particle circulation and are then discarded.

The developer fluid flowing into the applicator system with the applicator is thus accordingly divided into the first partial flow (in which are contained an accumulation of electrophoretically mobile toner particles) and the second partial flow (in which are contained an accumulation of electrophoretically immobile toner particles) solely with the aid of the counter-electrode and the separation electrode, using electrical fields. This second partial flow can then be discharged so that electrophoretic toner particles for the most part do not arrive at the applicator.

The FIGURE shows a section from a developer station ES, of which is shown only one rotating application roller 8 as an applicator with a mobility-selective separator 1 of toner particles. The remaining design of the developer station ES can be learned from WO 2007/082791 A1, for example. An application belt can also be used as an applicator.

The separator 1 is arranged adjacent to the application roller 8. This separator 1 has a counter-electrode 10, a separation electrode 9 and possibly an application electrode 11. The counter-electrode 10 is arranged adjacent to the application roller 8 such that a developer gap 2 (of <=1 mm in width, for example) between the application roller 8 and the counter-electrode 10 exists through which the developer fluid is transported from the entrance 4. The application roller 8 and the counter-electrode 10 respectively lie at an electrical potential U8, U10 so that an electrical field exists across the developer gap 2 (for example U(8, 10)=20V–2 kV). The electrical potentials U8, U10 are selected so that the toner particles that have the provided charge are drawn in the direction of the application roller 8. In the developer gap 2, depending on their charge (and therefore their electrophoretic mobility) the toner particles are thus drawn toward the application roller 8 or remain in the developer fluid between the application roller 8 and the counter-electrode 10 at a distance from the application roller 8 that is dependent on their charge. Therefore, there exist in the developer gap 2 a first region adjacent to the application roller 8 in which the electrophoretically mobile toner particles are contained in an enriched amount and a second region situated adjacent to the counter-electrode 10 in which are contained in an enriched amount the electrophoretically immobile toner particles. If a separation electrode 9 is arranged at the exit of the developer gap 2 such that this protrudes into the developer gap 2 (as this is shown in the FIGURE, for example), the separation electrode 9 then divides the developer fluid into two partial flows 5 and 6. Toner particles in enriched number are then contained in the partial flow 5 that lies closer to the application roller 8 (corresponding to the first region), which toner particles have been drawn closer to the application roller 8 due to their charge in the electrical field between the application roller 8 and the counter-electrode 10 (toner particles of sufficient charge and therefore having electrophoretic mobility). In contrast to this, in the partial flow 6 that lies further removed from the application roller 8 and adjacent to the counter-electrode 10 (corresponding to the second region), toner particles are then contained in an enriched amount that have not been drawn to the application roller 8 (or have been drawn less strongly) due to their charge in the electrical field between the application roller 8 and the counter-electrode 10 (toner particles of insufficient charge and therefore insufficient electrophoretic mobility). With the aid of the separation electrode 9, toner particles that have too little charge and electrophoretic mobility can thus be extracted from the developer fluid at the exit of the developer gap 2. The second partial flow 6 can be conducted back into the developer station via a discharge channel 14 (from 100 to 700 μm in width, for example) that exists between the separation electrode 9 and the counter-electrode 10. In order to achieve a disruption-free discharge, the separation electrode 9 can be matched or adapted in terms of its shape to that of the counter-electrode 10.

This method for separation of electrophoretically mobile toner particles from electrophoretically immobile toner particles can be further improved if an additional electrode pair is arranged at the intake or entrance 4 of the separator 1 (not shown in the FIGURE), which additional electrode pair generates such an electrical field that the electrophoretically immobile toner particles are already suitably pre-positioned before the counter-electrode 10, and thus remain in proximity to the counter-electrode 10.

A third electrical potential U9 can be applied to the separation electrode 9, which third electrical potential U9 is polarized so that no toner particles attach to the separation electrode 9; for example, the electrical potentials U9, U10 can be selected identically. The shape of the separation electrode 9 should furthermore be selected so that a laminar flow is optimally provided at the separation of the two partial flows 5, 6. For this the separation electrode 9 can taper to a point into the exit of the developer gap 2.

The electrical potentials U8, U10 can additionally be selected accordingly.

If the separation electrode 9 is arranged adjacent to the application roller 8 so that a gap 3 (for example of 50 to 300 μm in width) exists between them that continues the developer gap 2, toner particles can furthermore be supplied from the first partial flow 5 to the application roller 8. It is appropriate if the separation electrode 9 is executed so as to be adjustable, since then the distances to the counter-electrode 10 and the application roller 8 can be set.

An application electrode 11 can additionally be arranged adjacent to the counter-electrode 8 and the application roller 11 at the input of the developer gap 2, which application electrode 11 is executed such that it can be displaced. With this it can be prevented that developer fluid can escape at the entrance to the developer gap 2 into the region into which developer fluid is conveyed. An electrical potential U11 can be applied at the application electrode 11 that is set so that the toner particles are repelled from the application electrode 11 or so that the region between the counter-electrode 10 and the application electrode 11 is field-free (U11=U10).

If a suction unit 16 is arranged at the exit of the discharge channel 14, the second partial flow 6 can be sucked up. At the same time the movement of the developer fluid through the developer gap 2 can be affected. The movement of the developer fluid through the developer gap 2 can additionally be affected by the rotation of the application roller 8.

In order to prevent a depositing of toner particles on the electrodes 9, 10, 11, these can be coated with an electrically insulating material 7 or with an anti-adhesion material 7.

Additional known components of a developer station ES are shown in the FIGURE. For example, a cleaning unit 15 (for example a roller or a blade (scraper)) that cleans the application roller 8 of residual developer fluid remaining after the development of the charge images can be provided before the intake into the separator 1. Furthermore, a smoothing roller 12 that smoothes the layer of developer fluid on the application roller 8 can be arranged at the output of the transfer region 2, 3 for developer fluid. The smoothing roller 12 can be cleaned with a cleaning blade 13.

In an exemplary embodiment of the device according to the FIGURE, the predetermined charge of the toner particles should be positive, for example. The electrical potentials at the application roller 8 and the electrodes 9, 10, 11 can be set according to the following, for example:

$$U10>U8,U9=U10,U11=U10.$$

The toner particles conveyed into the intake flow 4 are exposed in a region between the electrodes 9 and 11 to an electrical field due to the potential difference between the application roller 8 and the counter-electrode 10. The influence of this electrical field on the toner particles is thereby different:

The positively charged toner particles 17 with the provided minimum charge (characterized by a "+" sign in the FIGURE) are moved in the direction of the electrical field towards the application roller 8, accumulate on the application roller 8, or accumulate in a first region that lies adjacent to the application roller 8.

The weakly positively charged toner particles 18 (with a charge weaker than the predetermined minimum charge; designated by "o" in the FIGURE) are less affected by the electrical field and move only slightly in the direction of the application roller 8.

Uncharged toner particles 18 (likewise designated by "o" in the FIGURE) remain unaffected by the electrical field in a region in which they were positioned in the intake flow 4.

Possibly present negatively charged toner particles 18 (likewise designated by "o" in the FIGURE) are repelled by the electrical field towards the counter-electrode 10.

Weakly positively charged toner particles and uncharged toner particles thus remain adjacent to the counter-electrode 10 in a second region if they have been supplied adjacent to the counter-electrode 10 in the intake flow 4; negatively charged toner particles are repelled by the electrical field into the second region. These toner particles present in the second region are then sorted out into the second partial flow 6.

In contrast to this, the toner particles that accumulate on the application roller 8 are transported away by the rotating application roller 8.

In order to ensure an unhindered flow of the developer fluid through the developer station ES, it is appropriate to respectively match the separation electrode 9, the counter-electrode 10, and the application electrode 11 in terms of their shape to the application roller 8.

A significant advantage of the preferred embodiment lies in the improvement of the print quality. This is achieved:

via the discharge of toner particles with insufficient or incorrect (wrongly charged toner particles) electrophoretic mobility.

via the selection of toner particles, the layer on the application roller 8 is compacted more uniformly by the electrodes 9 and 10, whereby a more uniform layer results after the smoothing roller 12.

Although a preferred exemplary method embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should by protected.

I claim as my invention:

1. A device to develop charge images of images to be printed that are generated on a charge image carrier, said development taking place using a developer fluid having at least carrier fluid and toner particles charged to a predetermined charge, in an electrophoretic printing apparatus, comprising:

a rotating applicator at a first electrical potential and that accepts developer fluid provided into a developer gap and transports the developer fluid to the charge image carrier;

a counter-electrode at a second electrical potential arranged adjacent to the applicator, the developer gap being between the counter-electrode and the applicator, an electrical field that draws the toner particles of the predetermined charge in a direction of the applicator being between the counter-electrode and applicator due to the first electrical potential and the second electrical potential; and a separation electrode protruding into the developer gap at an exit of the developer gap and adjacent to the counter-electrode and the applicator, said separation electrode forming a discharge channel together with the counter-electrode, the separation electrode splitting the developer fluid moving through the developer gap into a first partial flow that remains adjacent to the applicator and a second partial flow that flows away in the discharge channel.

2. The device according to claim 1, in which a suction unit is arranged at an output of the discharge channel.

3. The device according to claim 1 in which the separation electrode tapers to a point in the developer gap and, at the counter-electrode has a shape matched to a shape of said counter-electrode.

4. The device according to claim 3 in which a segment of the separation electrode facing towards the applicator forms at said applicator a gap that continues the developer gap.

5. The device according to claim 4 in which a third electrical potential is applied to the separation electrode, said potential being polarized such that the electrical field formed by the potential at the applicator moves the toner particles of the predetermined charge into the first partial flow to said applicator.

6. A device to develop charge images of images to be printed that are generated on a charge image carrier, said development taking place using a developer fluid having at least carrier fluid and toner particles charged to a predetermined charge, in an electrophoretic printing apparatus, comprising:

a rotating applicator at a first electrical potential and that accepts developer fluid provided into a developer gap and transports the developer fluid to the charge image carrier;

a counter-electrode at a second electrical potential arranged adjacent to the applicator, the developer gap being between the counter-electrode and the applicator, an electrical field that draws the toner particles of the predetermined charge in a direction of the applicator being between the counter-electrode and applicator due to the first electrical potential and the second electrical potential;

a separation electrode protruding into the developer gap at an exit of the developer gap and adjacent to the counter-electrode and the applicator, said separation electrode forming a discharge channel together with the counter-electrode, the separation electrode splitting the developer fluid moving through the developer gap into a first partial flow that remains adjacent to the applicator and a second partial flow that flows away in the discharge channel;

the separation electrode tapering to a point in the developer gap and, at the counter-electrode has a shape matched to a shape of said counter-electrode;

a segment of the separation electrode facing towards the applicator forming at said applicator a gap that continues the developer gap;

a third electrical potential being applied to the separation electrode, said potential being polarized such that the electrical field formed by the potential at the applicator moves the toner particles of the predetermined charge into the first partial flow to said applicator; and an application electrode being arranged at an entrance to the developer gap adjacent to the counter-electrode and the applicator, said application electrode being at a fourth electrical potential polarized such that an electrical field formed thereby repels the toner particles in the developer fluid, or such that a region between the counter-electrode and the application electrode is field-free.

7. The device according to claim 6 in which the counter-electrode, the separation electrode, and the application electrode are coated with an electrically insulating material or with an anti-adhesion material.

8. The device according to claim 6 in which the separation electrode and the application electrode are arranged such that they are displaceable relative to the counter-electrode and the applicator.

9. A device to develop charge images of images to be printed that are generated on a charge image carrier, said development taking place using a developer fluid having at least carrier fluid and toner particles charged to a predetermined charge, in an electrophoretic printing apparatus, comprising:

a rotating applicator at a first electrical potential and that accepts developer fluid provided into a developer gap and transports the developer fluid to the charge image carrier;

a counter-electrode at a second electrical potential arranged adjacent to the applicator, the developer gap being between the counter-electrode and the applicator, an electrical field that draws the toner particles of the predetermined charge in a direction of the applicator being between the counter-electrode and applicator due to the first electrical potential and the second electrical potential;

a separation electrode protruding into the developer gap at an exit of the developer gap and adjacent to the counter-electrode and the applicator, said separation electrode forming a discharge channel together with the counter-electrode, the separation electrode splitting the developer fluid moving through the developer gap into a first partial flow that remains adjacent to the applicator and a second partial flow that flows away in the discharge channel; and an additional electrode pair being arranged at an entrance to the developer gap, said additional electrode pair affecting the developer fluid moved into the developer gap such that the toner particles of weak or incorrect electrophoretic mobility are positioned in a direction towards the counter-electrode so that they arrive in the second partial flow given the separation by the separation electrode.

10. A method to develop charge images generated on a charge image carrier with aid of a rotating applicator that moves developer fluid having charged toner particles charged to a predetermined charge and carrier fluid past a charge image carrier, comprising the steps of:

moving the developer fluid into a developer gap between the applicator and a counter-electrode and exposing the developer fluid to an electrical field between the counter-electrode and the applicator, in the toner particles of said predetermined charge being moved in a direction of the applicator depending on their charge, uncharged toner particles remaining unaffected, and toner particles of opposite charge being repelled; and via a separation electrode protruding into the developer gap, dividing the developer fluid in the developer gap at an exit of said developer gap into a first partial flow arranged adjacent to the application electrode and into a second partial flow arranged adjacent to the counter-electrode where the second partial flow is discharged.

11. A device to develop charge images of images to be printed that are generated on a charge image carrier, the development taking place using a developer fluid having carrier fluid and particles charged to at least a predetermined minimum charge in an electrophoretic printing apparatus, comprising:

a rotating applicator at a first electrical potential that accepts developer fluid provided into a developer gap and transports the developer fluid to the charge image carrier;

a counter-electrode at a second electrical potential arranged adjacent to the applicator, the developer gap being between the counter-electrode and the applicator, an electrical field that draws the toner particles of the at least predetermined minimum charge in a direction of the applicator being between the counter-electrode and the applicator due to the first electrical potential and the second electrical potential; and a separation electrode having a wedge-shaped portion protruding into the developer gap at an exit of the developer gap and adjacent to the counter-electrode in the applicator, said separation electrode forming a discharge channel together with the counter-electrode, the separation electrode splitting the developer fluid moving through the developer gap into a first partial flow that remains adjacent to the applicator and which comprises mainly said toner particles charged to at least said minimum predetermined charge, and a second partial flow that flows away at a discharge channel and comprises mainly toner particles which are charged to less than said at least minimum predetermined charge.

12. A method to develop charge images generated on a charge image carrier with aid of a rotating applicator that moves developer fluid having charge toner particles charged to at least a minimum predetermined charge and carrier fluid past the charge image carrier, comprising the steps of:

moving the developer fluid into a developer gap between the applicator and a counter-electrode and exposing the developer fluid to an electrical field between the counter-electrode and the applicator, the toner particles of at least said minimum predetermined charge being moved in the direction of the applicator, and toner particles less than at least said predetermined minimum charge not being attracted toward said applicator; and the separation electrode having a wedge-shaped portion protruding into the developer gap dividing the developer fluid in the developer gap at an exit of said developer gap into a first partial flow arranged adjacent to the application electrode comprising mainly said particles of at least said minimum predetermined charge, and into a second partial flow arranged adjacent to the counter-electrode where it is discharged and comprising mainly said toner particles of less than said at least minimum predetermined charge.

* * * * *